US005811710A

United States Patent [19]

Blucher et al.

[11] Patent Number: 5,811,710

[45] Date of Patent: Sep. 22, 1998

[54] ELECTROMAGNETIC PICKUP FOR STRINGED MUSICAL INSTRUMENTS

[75] Inventors: Steven L. Blucher, New York; Michael T. Altilio, Staten Island, both of N.Y.

[73] Assignee: DiMarzio, Inc., Staten Island, N.Y.

[21] Appl. No.: 818,216

[22] Filed: Mar. 14, 1997

[51] Int. Cl.[6] ..... G10H 3/18

[52] U.S. Cl. ..... 84/728

[58] Field of Search ..... 84/726–728; 336/110, 336/220, 221

[56] References Cited

U.S. PATENT DOCUMENTS

| | | | |
|---|---|---|---|
| 2,896,491 | 7/1959 | Lover | 84/1.15 |
| 3,588,311 | 6/1971 | Zoller | 84/1.15 |
| 3,711,619 | 1/1973 | Jones et al. | 84/1.15 |
| 3,902,394 | 9/1975 | Stich | 84/728 |
| 3,916,751 | 11/1975 | Stich | 84/1.15 |
| 4,372,186 | 2/1983 | Aaroe | 84/1.15 |
| 4,442,749 | 4/1984 | DiMarzio et al. | 84/1.15 |
| 4,501,185 | 2/1985 | Blucher | 84/1.15 |
| 4,809,578 | 3/1989 | Lace, Jr. | 84/1.15 |
| 5,168,117 | 12/1992 | Anderson | 84/726 |
| 5,354,949 | 10/1994 | Zwaan | 84/727 |
| 5,530,199 | 6/1996 | Blucher | 84/728 |
| 5,668,520 | 9/1997 | Kinman | 84/728 X |

*Primary Examiner*—Stanley J. Witkowski
*Attorney, Agent, or Firm*—Baker & Botts, L.L.P.

[57] ABSTRACT

An electromagnetic pickup for a stringed musical instrument has an upper bobbin having an upper bobbin body and an upper bobbin coil of wire wrapped around the upper bobbin body; a lower bobbin positioned below and coaxial to the upper bobbin, the lower bobbin having a lower bobbin body and a lower bobbin coil of wire wrapped around the lower bobbin body, the bodies mountable on the instrument proximate and below the strings, the coils having axes perpendicular to the strings; an integral plate of ferromagnetic material including a base disposed between the upper bobbin and lower bobbin perpendicular to the coil axis and two side walls extending upwardly and perpendicularly from the base; and a magnetic system extending through at least the upper bobbin body and in contact with the base of the integral plate for generating a magnetic field around the bobbins, wherein the side walls include a cut-away area positioned below one or more of the ferromagnetic strings.

13 Claims, 4 Drawing Sheets

ELECTROMAGNETIC PICKUP FOR STRINGED MUSICAL INSTRUMENTS

This invention relates to transducers, or electromagnetic pickups, for musical instruments and more particularly, to hum-cancelling pickups for electrical string instruments which provide a strong signal to be amplified into sound with a truer, more pleasing tonal quality.

BACKGROUND OF THE INVENTION

Electromagnetic pickups are used with stringed musical instruments, such as electric guitars, to convert the vibrations of "picked" strings into electrical signals for subsequent amplification into sound. The pickups usually comprise a magnet system, including one or more permanent magnet elements, to establish a magnetic field within which the strings vibrate, and coils wound on bobbins disposed in the field to generate electrical signals corresponding to flux variations in the field due to the strings' vibrations. These electrical signals are amplified into musical sounds by circuits and equipment well-known in the trade.

Typically, the magnets, or pole pieces, of a pickup are situated through the bobbins and the pickup itself is generally mounted on the face of the instrument below the strings. The coils for developing the electrical signals are wound on bobbins arranged so that the pole pieces are within the coils to allow the magnetic field developed by the magnet and pole pieces to envelope the coil. Each string, when set into motion, causes variations in the magnetic field in the vicinity of the pole piece or pieces and the variations are converted into electrical signals by the interaction of the magnetic field with the coil.

One particular type of an electromagnetic pickup is the dual-coil, or "humbucking," pickup which was developed to address the problem of 60 cycle signals being converted into an audible hum, thereby distorting and degrading the quality of the musical sound. One known arrangement of this pickup utilizes two coils disposed one above the other, separated by a flat magnetic shield. In this arrangement, the two coils are disposed out of phase such that the 60 cycle currents produced in the coils by interfering sources cancel one another out. This may be accomplished through reversing the winding direction of the second coil, or more usually accomplished with the two coils wound in the same direction, but connected out of phase. As a result, the audible hum is eliminated. However, this arrangement has a disadvantage of not producing a strong signal.

In U.S. Pat. No. 4,442,749, issued Apr. 17, 1984, to one of the present inventors, and herein incorporated by reference, a hum-cancelling pickup is disclosed with a relatively thin integral plate of magnetizable material including a base disposed between the two "vertically-mounted" bobbins and two side walls extending upwardly to at least immediately below the top face of the upper bobbin. The plate is disclosed as functioning as a transmission medium for the directed flow of magnetic field creating an efficient field interaction with the magnets and the strings. Hence, the signal is strenthened.

It is known in the prior art that increasing the inductance of a magnetic transducer (or pickup) may have a direct and favorable bearing on the tonality of sound produced by the instrument. If the integral plate disclosed in U.S. Pat. No. 4,442,749 is manufactured to be relatively thicker, the inductance of the magnetic field produced by the pickup will be increased. However, increasing the inductance of the pickup in this manner results in a more highly directed and strengthened magnetic field causing a distortion of the natural vibration of some of the strings of the instrument, especially those which normally vibrate at lower frequencies. This distortion results in a deterioration of the tonal quality of the instrument.

It is a primary objective of the present invention to provide an electromagnetic pickup that provides a more pleasing tonal quality due to an increased inductance and solves the problem of distortion of sound due to a thickening of the integral plate and concomitant increase in magnetic field.

SUMMARY OF THE INVENTION

The present invention overcomes the prior art limitations by providing a cut-away in the sidewalls of the integral plate disposed between the bobbins. Locating the cut-away below the strings of the instrument which vibrate at a frequency relatively lower than the others lessens or eliminates the increase in the magnetic field about those strings due to the plate, thereby preventing a deterioration of the sound of the instrument.

An electromagnetic pickup device for a stringed musical instrument having a plurality of ferromagnetic strings, according to the present invention, includes an upper bobbin having a body and a coil of wire wrapped therearound; a lower bobbin positioned below and coaxial to the upper bobbin, and having a body and a coil of wire wrapped therearound, the bodies mountable on the instrument proximate and below the strings, the coils having axes perpendicular to the strings; an integral plate of ferromagnetic material comprising a base disposed between the upper bobbin and lower bobbin perpendicular to the coil axes and two side walls extending upwardly and perpendicularly from the base of the integral plate; and a magnetic system extending through at least the body of the upper bobbin and in contact with the base of the integral plate for generating a magnetic field around the bobbins, wherein the side walls include a cut-away area positioned below one or more of the ferromagnetic strings. This arrangement provides a strong output signal from the instrument while maintaining a favorable level of tonality. The cut-away may be gradual or abrupt in shape.

Preferably the body of the upper bobbin has one or more holes therethrough and the magnetic system includes a plurality of pole pieces extending through the holes parallel to the axis of said upper bobbin coil. Preferably, the pole pieces are magnets having like polarities at the tops thereof. Preferably, the electromagnetic pickup includes ferromagnetic material positioned within and/or below said lower bobbin body to increase the inductance of the pickup.

In another preferred embodiment, bodies of both bobbins and the integral plate all include one or more holes therethrough and the magnetic system includes two or more pole pieces extending through the holes of the upper bobbin body, the base of the integral plate and the lower bobbin body, parallel to the axes of the coils. In this embodiment, it is also preferable for the electromagnetic pickup to include at least one permanent magnet having a first edge and a second edge of opposite polarities. The magnet should be positioned in close proximity to the lower bobbin to create the magnetic field therearound, and the pole pieces are made of ferromagnetic material and are in contact with the magnet.

Preferably, the pickup further includes ferromagnetic material in the form of cylindrical rods disposed within and/or between the holes of the lower bobbin body to increase the inductance of the pickup.

In another preferred embodiment, the magnetic system includes a permanent magnet positioned within the upper bobbin body with a first edge, preferably constituting magnetic north pole, facing said strings and a second edge, preferably constituting magnetic south pole, facing and in contact with the base of the integral plate.

BRIEF DESCRIPTION OF THE DRAWING

Further objects, features and advantages of the invention will become apparent from the following detailed description taken in conjunction with the accompanying figures in which.

Figure 1:
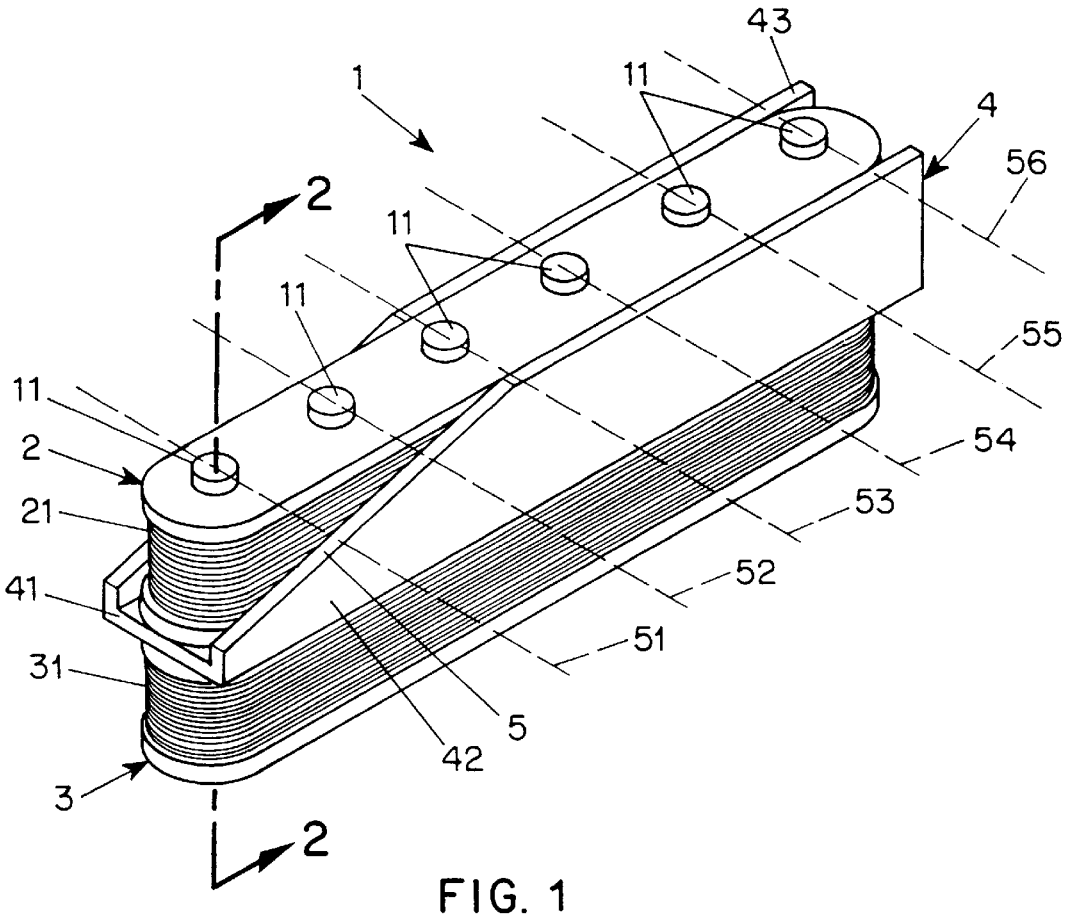
FIG. 1 is a perspective view of a pickup in accordance with a preferred embodiment of the invention.

Throughout the figures, the same reference numerals and characters, unless otherwise stated, are used to denote like features, elements, components or portions of the illustrated embodiment. Moreover, while the subject invention will now be described in detail with reference to the figures, it is done so in connection with preferred embodiments. It is intended that changes and modifications can be made to the described embodiments without departing from the true scope and spirit of the subject invention as defined by the appended claims.

DETAILED DESCRIPTION

Figure 2:
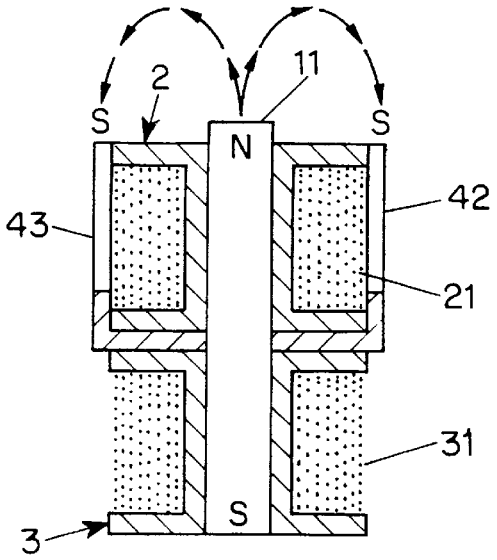
FIG. 2 is a cross-sectional view of the pickup taken along the lines 2—2' of FIG. 1.
Figure 3:
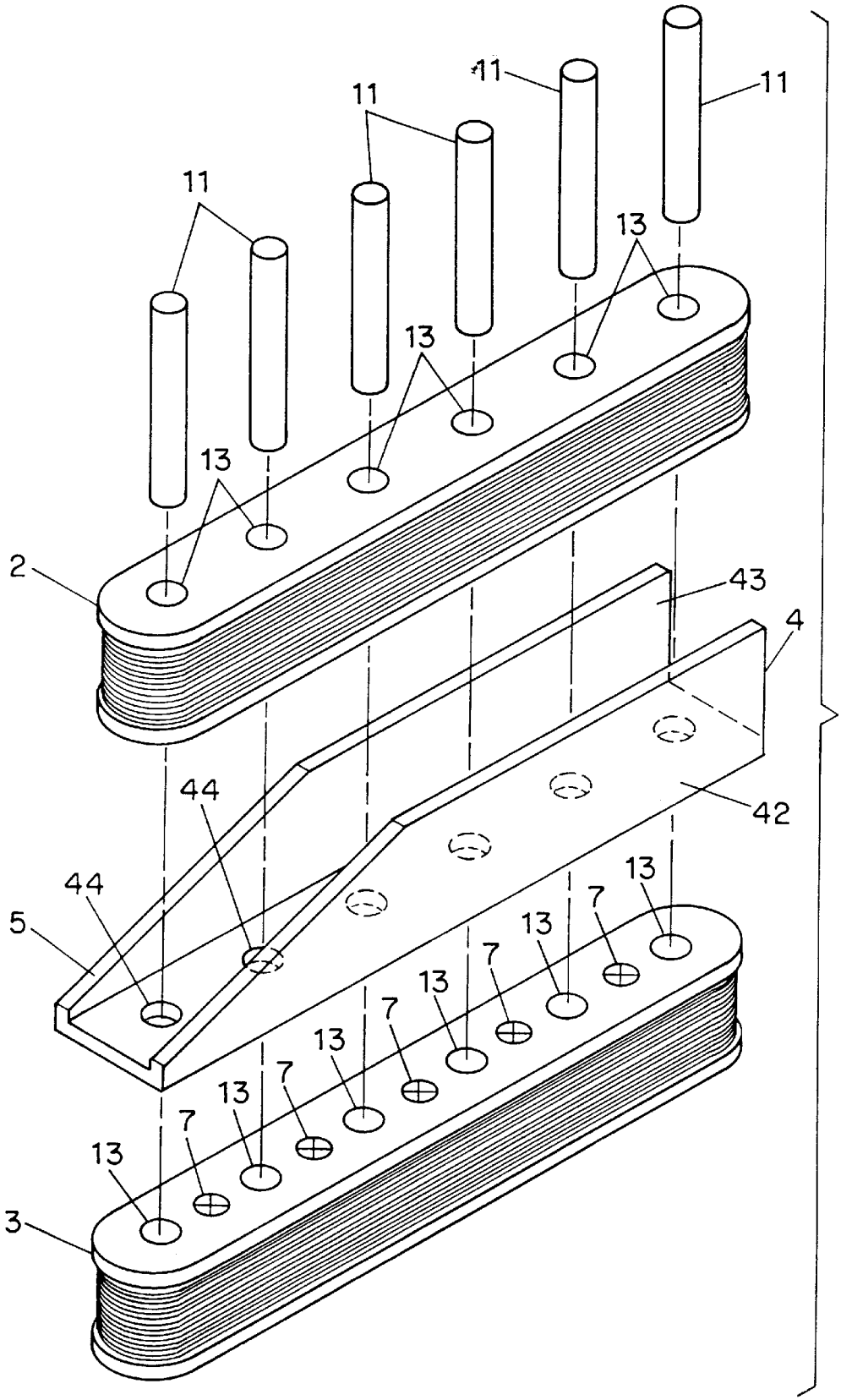
FIG. 3 is a perspective view of the elements of the pickup of FIGS. 1 and 2.

FIGS. 1–3 illustrate a preferred embodiment of the present invention. Pickup 1 includes two superposed coaxial bobbins 2, 3, with bobbin 2 being the upper bobbin and bobbin 3 being the lower bobbin relative to the strings 51–56. Strings 51–56 normally have different thicknesses and natural frequencies of vibration. In this embodiment, string 51 is the thickest and vibrates with the lowest frequency, incrementally increasing to string 56, which is the thinnest and vibrates with the highest frequency. Bobbins 2 and 3 are wound with an appropriate gauge and amount of wire to produce coils 21 and 31, respectively, as is known to those skilled in the art. The bobbins are separated by, and attached to, an integral plate 4. Plate 4 is constructed from a single piece of metal, preferably iron or another magnetic material, which is bent to form a base 41 and side walls 42, 43 perpendicular to the base 41, as shown in FIG. 2. The side walls may be further extended so that they wrap around (not shown) at least one of the ends of the upper bobbin.

In the preferred embodiment of FIGS. 1–3, the bobbins 2, 3 have holes 13 in their bodies and the integral plate 4 has holes 44. Magnets 11, preferably in the form of cylindrical pole pieces, are arranged so that they fit through the holes 13 and holes 44 and are in contact with the base 41 of the integral plate 4. The polarity is lengthwise so that, in the embodiment shown, the north pole of each magnet faces upwards, as shown in FIG. 2. The magnetic field resulting from the arrangement of the magnets 11 and the plate 4 is also shown in FIG. 2. As known to those skilled in the art, ferromagnetic pole pieces in combination with at least one permanent magnet located in close proximity with the lower bobbin may be substituted for the magnets 11. Also, a permanent magnet (not shown) placed within the body of the upper bobbin body with its first edge constituting a magnetic north pole facing the strings and its second edge constituting a magnetic south pole facing and in contact with the base of the integral plate may be used to create the necessary magnetic field.

Because this focused magnetic field, especially when the plate has a fairly substantial thickness, can impede the natural vibrations of one or more of the strings which normally vibrate at a relatively low frequency when picked, a cut-away of the side walls is included in the pickup of the present invention. The cut-away is located below the one or more strings which are adversely affected by the more intensified magnetic field created by the thicker plate. A cut-away, in accordance with the present invention, is defined as an area of the integral plate where the side walls are relatively shorter than the side walls of other areas of the plate. As shown in FIGS. 1–3, the cut-away 5 may take the form of a gradual shortening of the side walls 42, 43 from the area of the plate 4 below string 53 to the area of the plate 4 below string 51. This gradual shortening of the side walls is advantageous because without a cut-away the focused magnetic field created by a conventional thicker plate would be the same for all three strings 51 to 53 despite their different thicknesses, thus affecting the natural vibration of string 51 more than string 52, and the natural vibration of string 52 more than string 53. Consequently, a gradual shortening of the side walls takes into account the sizes of the strings and creates a focused magnetic field of different magnitude for the different strings, optimizing the inductance of the pickup without adversely affecting or distorting the natural vibrations of the strings.

Figure 6A:
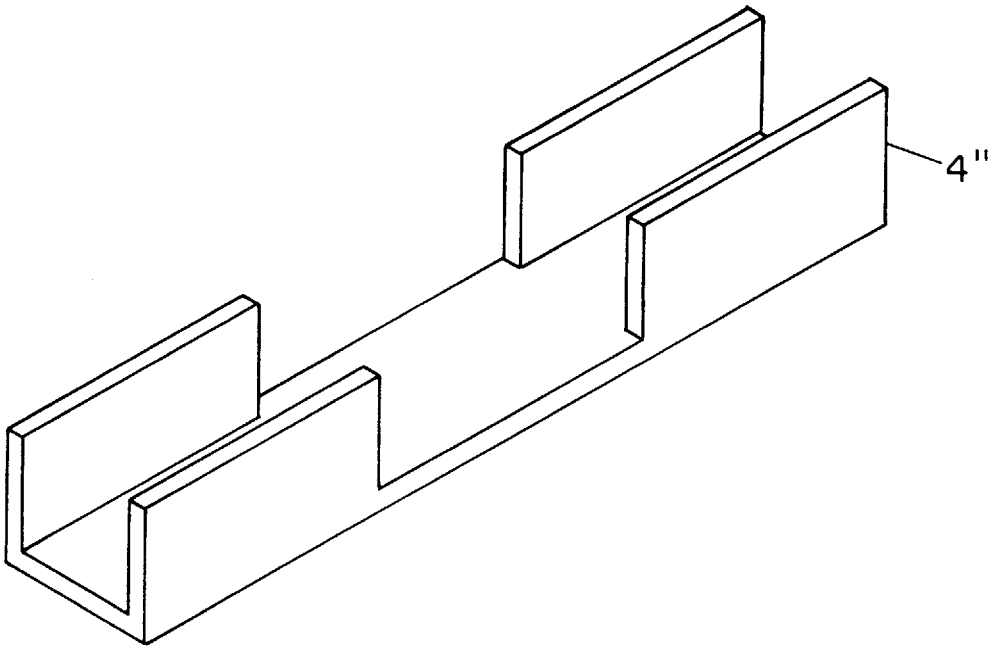
FIGS. 6*a* and 6*b* are side views of other preferred embodiments of the integral plate according to the present invention.
Figure 6B:
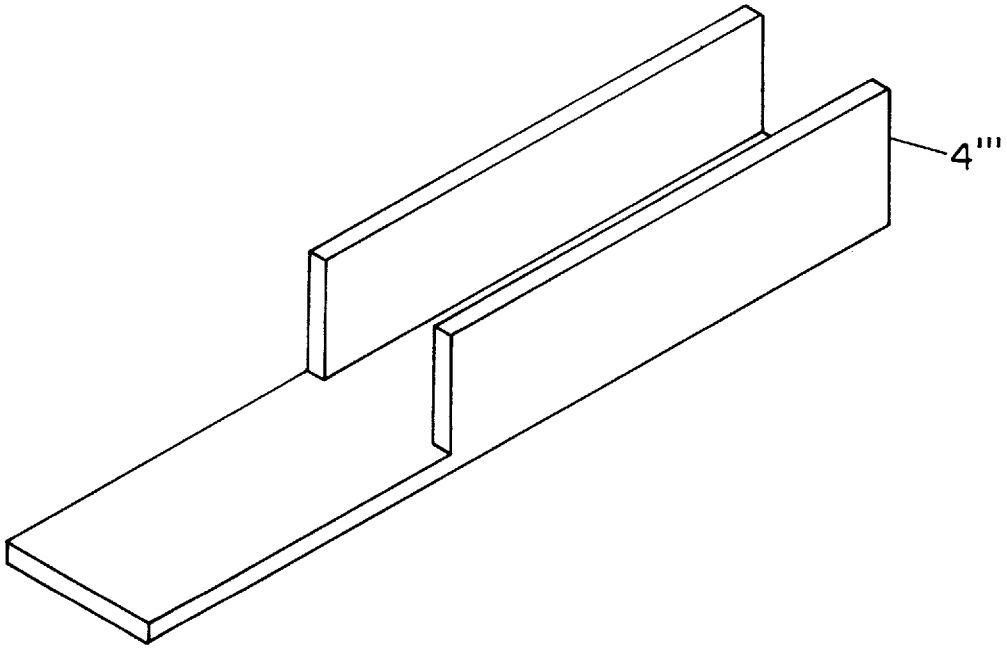

In other embodiments, the shortening of the side walls may be abrupt rather than gradual (due to an equivalent effect of the thicker plate on the strings) and the cut-away may occur at any area of the plate below which an affected string or strings vibrate. FIGS. 6*a* and 6*b* illustrate two such embodiments of the integral plates (5 and 6, respectively). In any case, the cut-away is preferably made in the same manner and the same location on opposing side walls.

As a result of using the cut-away according to the present invention, the side walls 42, 43 create, immediately above the pickup, a focused magnetic field of differing magnitude along the length of the plate 4 so that the strings 51–56 vibrate naturally in the field and induce a sufficiently powerful electric current to create high output with good tonality. Coils 21, 31 are preferably connected together in series or in parallel so that the current flows clockwise in one coil and counterclockwise in the other to enable the cancellation of externally induced hum.

Figure 4:
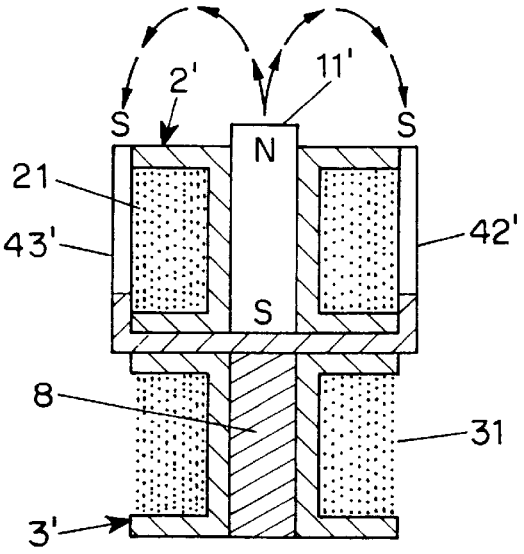
FIG. 4 is a perspective view of the elements of a pickup in accordance with an alternate embodiment of the invention.
Figure 5:
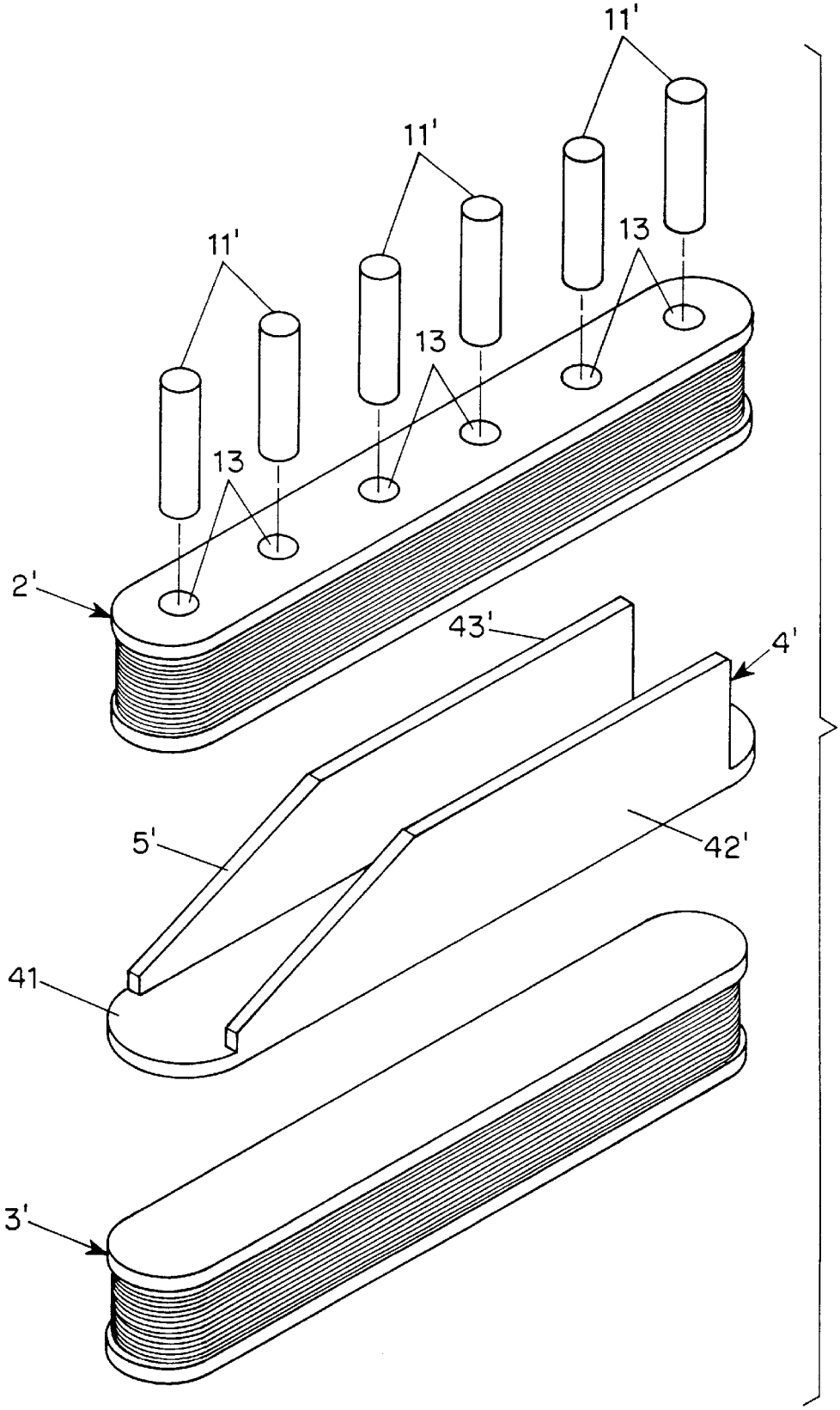
FIG. 5 a cross-sectional view of the pickup of FIG. 4 when fully assembled taken along the same lines as those in FIG. 1.

FIGS. 4 and 5 illustrate another preferred embodiment of the present invention wherein bobbin 3' and the base 41' of plate 4' have no holes. In this embodiment, magnets 11' are only of sufficient length to extend through holes 13 in bobbin 2 with their bottoms contacting base 41' as shown in FIG. 4. A cut-away 5' of the side walls 42', 43' is included in a similar manner as the embodiment of FIGS. 1–3, except it is located a shorter distance along the length of the plate 4' below the first two magnets 11' only. This embodiment of the integral plate could be used when strings 51 and 52 are the strings adversely affected by the thicker plate.

As described in the inventor's co-pending application, filed Feb. 27, 1997, herein incorporated by reference, additional ferromagnetic material may be added to the preferred embodiments of the present invention to further increase the inductance of the pickup without distorting the sound, thereby improving the tonality of the instrument. For example, ferromagnetic material in the form of cylindrical plugs can be placed within and/or between the holes 13 of bobbin 3 or otherwise within the body of bobbin 3' as disclosed in the co-pending application. In FIG. 3, ferromagnetic plugs 7 are preferably included in this regard. In FIG. 4, ferromagnetic material 8 is disposed in the core of bobbin 3'. Another embodiment may include ferromagnetic material below the body of bobbin 3 or 3'.

Other modifications of the invention will occur to those skilled in the art and it is intended that the scope of the invention be limited only as set forth in the appended claims.

I claim:

1. An electromagnetic pickup device for a stringed musical instrument having a plurality of ferromagnetic strings at least two of which have different thicknesses and natural frequencies of vibration, comprising:

an upper bobbin comprising an upper bobbin body and an upper bobbin coil of wire wrapped around said upper bobbin body;

a lower bobbin positioned below and coaxial to said upper bobbin, said lower bobbin comprising a lower bobbin body and a lower bobbin coil of wire wrapped around said lower bobbin body, said bodies mountable on said instrument proximate and below said strings, said coils having axes perpendicular to said strings;

an integral plate of ferromagnetic material comprising a base disposed between said upper bobbin and lower bobbin perpendicular to the coil axes and two side walls extending upwardly and perpendicularly from said base, at least one of said side walls including a cut-away area below one or more of said ferromagnetic strings depending upon the relative thicknesses of said strings; and a magnetic system extending through at least said upper bobbin body and in contact with said base of said integral plate for generating a magnetic field around said bobbin.

2. The electromagnetic pickup of claim 1 wherein said upper bobbin body further comprises one or more holes therethrough and wherein said magnetic system comprises a plurality of pole pieces extending through said holes of said upper bobbin body parallel to the axis of said upper bobbin coil.

3. The electromagnetic pickup of claim 2 wherein the pole pieces are magnets.

4. The electromagnetic pickup of claim 3 wherein said pole pieces have like polarities at the tops thereof.

5. The electromagnetic pickup of claim 1 wherein said bodies of said bobbins and said integral plate further comprise one or more holes therethrough and wherein said magnetic system comprises a plurality of pole pieces extending through said holes of said upper bobbin body, said base of said integral plate and said lower bobbin body, parallel to the axes of said coils.

6. The electromagnetic pickup of claim 5 further comprising at least one permanent magnet having a first edge and a second edge of opposite polarities, said magnet positioned in close proximity to said lower bobbin to create said magnetic field therearound, and wherein said pole pieces are made of ferromagnetic material and are in contact with said magnet.

7. The electromagnetic pickup of claim 1 further comprising ferromagnetic material positioned within and/or below said lower bobbin body to increase an inductance of said pickup.

8. The electromagnetic pickup of claim 1 wherein said magnetic system comprises a permanent magnet positioned within said upper bobbin body with a first edge facing said strings and a second edge facing and in contact with said base of said integral plate.

9. The electromagnetic pickup of claim 8 wherein said first edge of said magnet constitutes a magnetic north pole and said second edge of said magnet constitutes a magnetic south pole.

10. The electromagnetic pickup of claim 5 further comprising ferromagnetic material positioned within and/or between said holes of said lower bobbin body.

11. The electromagnetic pickup of claim 10 wherein said ferromagnetic material is in the form of cylindrical rods.

12. The electromagnetic pickup of claim 1 wherein said cut-away is a gradual cut-away.

13. The electromagnetic pickup of claim 1 wherein said cut-away is an abrupt cut-away.

* * * * *